US005267713A

United States Patent [19]

Lewis

[11] Patent Number: 5,267,713

[45] Date of Patent: Dec. 7, 1993

[54] DEVICE FOR ADJUSTING THE HEIGHT OF AN ARTICLE OF FURNITURE

[76] Inventor: John H. Lewis, 2205 Jonathan Ct., Euless, Tex. 76040

[21] Appl. No.: 916,549

[22] Filed: Jul. 20, 1992

[51] Int. Cl.[5] ..... F16M 11/24

[52] U.S. Cl. ..... 248/188.2; 248/188.4; 108/144; 108/158

[58] Field of Search ..... 248/188.2, 188.4, 912, 248/188; 108/144, 148, 156, 158, 153, 12

[56] References Cited

U.S. PATENT DOCUMENTS

| | | | |
|---|---|---|---|
| 393,339 | 11/1888 | Morgan | 108/157 |
| 891,143 | 6/1908 | Burns | 108/144 |
| 2,136,325 | 11/1938 | Smith . | |
| 2,398,693 | 4/1946 | Bureau | 248/188.2 |
| 2,726,126 | 12/1955 | Poel . | |
| 2,915,350 | 12/1959 | Sinclair | 108/156 |
| 3,058,794 | 10/1962 | Barber | 248/188.2 |
| 3,295,472 | 1/1967 | Larson | 108/144 |
| 4,456,212 | 6/1984 | Raftery | 248/188.2 |
| 4,662,591 | 5/1987 | Encontre | 108/158 |

*Primary Examiner*—Douglas D. Watts
*Assistant Examiner*—Hwei-Siu Payer
*Attorney, Agent, or Firm*—James E. Bradley

[57] ABSTRACT

An article of furniture comprises a plurality of brackets which attach to an underside of a platform and which provide for attachment of upper ends of a plurality of legs. Each bracket has a shorter support and a longer support. Each support has an end and an aperture therethrough. Each bracket has a slot having one end in the aperture of the shorter support and another end in the aperture of the longer support. A threaded fastener extends through the slot of each of the brackets and is slidably movable between the end of the slot in the shorter support and the end of the slot in the longer support. The fastener engages with the upper end of one of the legs to selectively secure the leg to one of the supports.

12 Claims, 2 Drawing Sheets

DEVICE FOR ADJUSTING THE HEIGHT OF AN ARTICLE OF FURNITURE

BACKGROUND OF THE INVENTION

1. Field of the Invention

This invention relates in general to furniture and, in particular to a method of adjusting the height of an article of furniture.

2. Description of the Prior Art

Most furniture heights are not adjustable and are, therefore, for use with either small children or adult-size persons. This limits the use of furniture based on the size of the user. As a result, more articles of furniture are required to fulfill the needs of different sized users at a greater expense to schools, libraries and in-home users.

Prior patents show height adjustments for articles of furniture using notches for the reception of supporting legs, hinged blocks or vertically slidable legs. The height adjustments appear to require time-consuming adjustments or are not stable enough to support more than negligible weight or jostling.

SUMMARY OF THE INVENTION

In this invention, the article of furniture is adjustable between two different heights by attaching the legs to an adjustable bracket. The adjustable brackets are mounted to the bottom of the table. The adjustable bracket has a longer support and a shorter support.

The longer support of the bracket and the shorter support of the bracket contain a slot through which a fastener is slidably moveable. The fastener can slide into the longer support, to which a leg can be attached for a taller furniture height. The fastener can slide through the slot into the shorter support to which a leg can be attached for a decrease in the height of the furniture.

The leg is attached to either the longer or the shorter support by rotatably fastening it to the threaded fastener. The threaded fastener is prevented from rotating by an internal retainer which is dimensioned to receive and retain the head of the fastener.

DETAILED DESCRIPTION OF THE INVENTION

Figure 1:
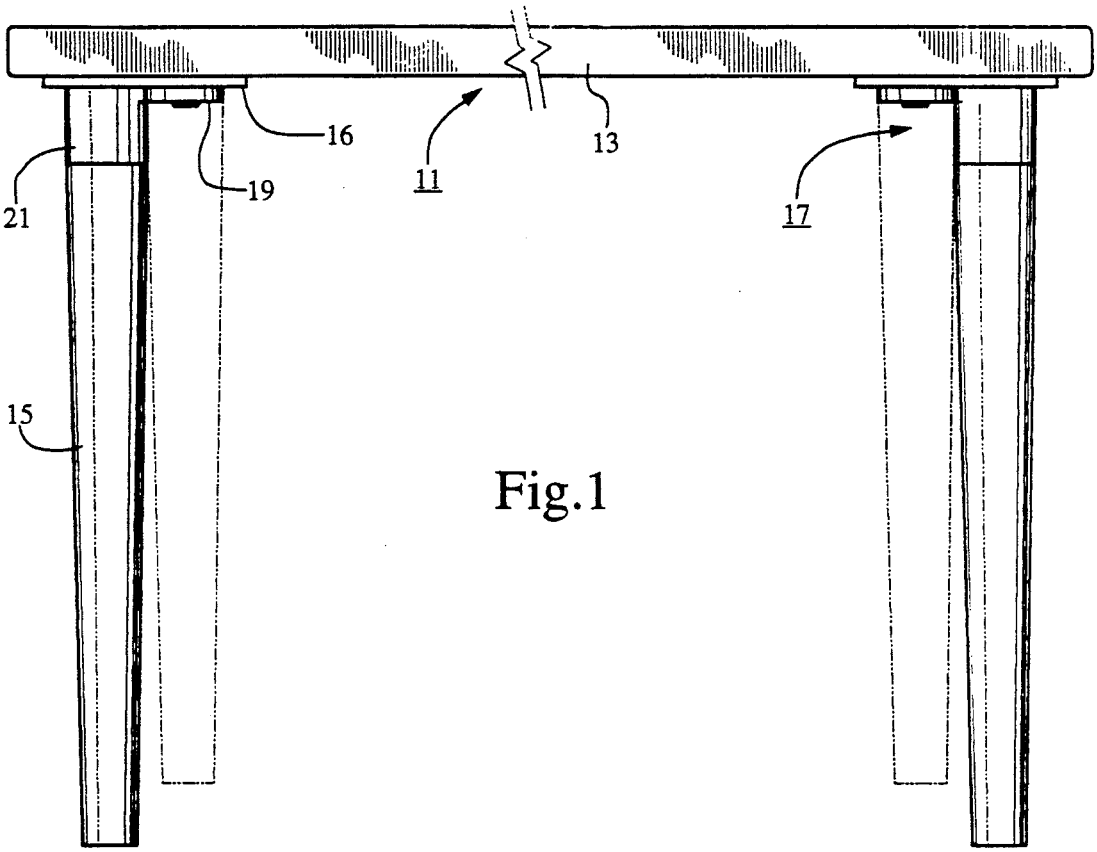
FIG. 1 is a schematic front view illustrating an article of furniture, and showing mounting brackets constructed in accordance with this invention for adjusting the height of the article of furniture.

Referring to the figures, an article of furniture or table 11 is shown in FIG. 1. Table 11 has a platform or top 13 and a plurality of legs 15. Each leg 15 secures to table 11 by a mounting bracket 17 which will adjust the height of table 11 between two elevations.

Each mounting bracket 17 includes a flat base 16, which is attached to the underside of the table 11 by screws 18 (only one shown) located in holes 20 located in the base 16. The bracket 17 has a shorter support 19 and a longer support 21, which extends farther from base 16 and thus the table 11 than the shorter support 19. Each support 19 and 21, is a hollow cylindrical member protruding from and formed integrally with base 16. Shorter support 19 is less than one-half the height of longer support 21 and preferably about one-fourth the height.

Figure 2:
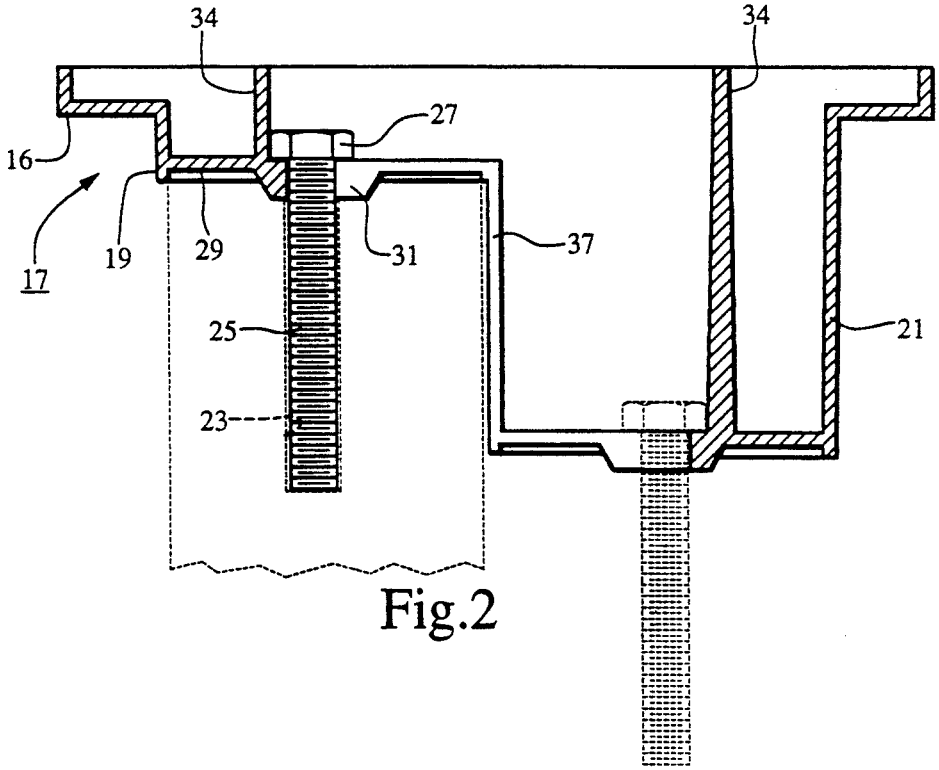
FIG. 2 is a sectional view of one of the mounting brackets of FIG. 1, taken along the line II—II of FIG. 4.

Each leg 15 may be attached to either the shorter support 19 or the longer support 21 by means of a fastener 25 as shown in FIG. 2. Fastener 25 is a bolt having a threaded shank and a head 27, which is preferably hexagonal. Fastener 25 secures to a threaded receptacle 23 formed in the end of each leg 15.

Figure 4:
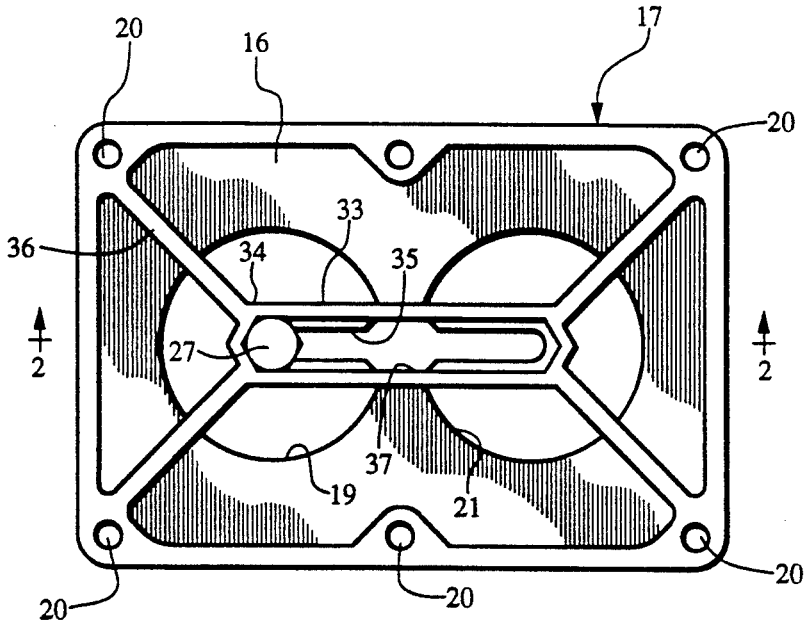
FIG. 4 is a bottom view of one of the mounting brackets of FIG. 1.

Each support 19, 21 has a flat end 29 and an aperture 31 extending therethrough. Referring to FIG. 4, a bolt head housing 33 is formed integrally in the bracket 17. Bolt head housing 33 has two parallel sidewalls which are joined on each end by polygonal end walls 34. End walls 34 locate on a centerline with each aperture 31 and comprise two wall portions of a hexagonal shape. The width of bolt head housing 33 and the dimensions of the end walls 34 are selected to closely receive the fastener head 27 to serve as a retainer to prevent fastener 25 from rotating.

A pair of ledges 35 locate in bolt head housing 33 to retain the fastener head 27 within each support 19, 21. Ledges 35 are located on each side of each aperture 31 of each support 19, 21. Housing 33 extends from base 16 to the end 29 of each support 19, 21. Braces 36 join the housing 33 to the side edges of base 16 for support.

Figure 3:
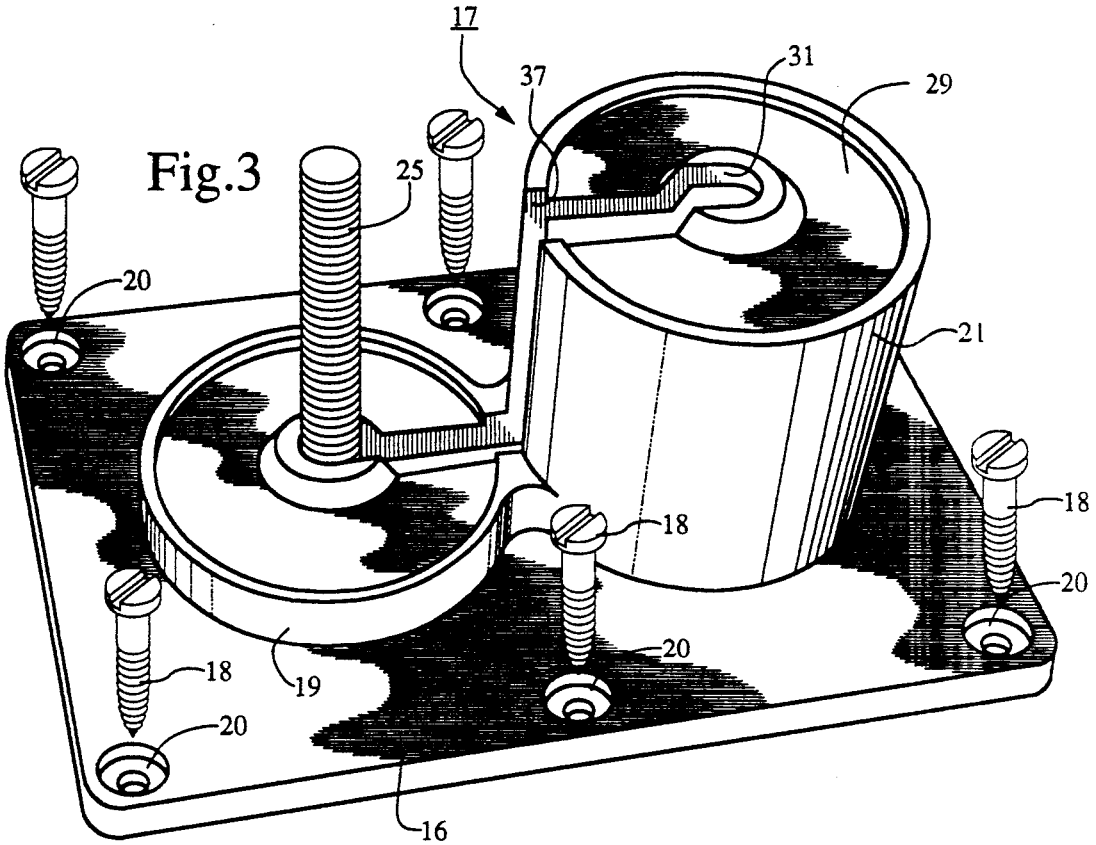
FIG. 3 is a perspective top view of one of the mounting brackets of FIG. 1.

Referring to FIGS. 2 and 3, a slot 37 extends between the apertures 31 of the shorter support 19 and the longer support 21. Slot 37 extends through the ends 29 of each support 19, 21 and through the side wall of the longer support 21. The width of slot 37 is less than the diametrical dimension of the head 27 of fastener 25 but slightly greater than the diameter of the shank of fastener 25.

In operation, referring to FIG. 2, the fastener 25 may be selectively positioned in the shorter support 19 or the longer support 21. The leg 15 is attached to the fastener 25 by inserting fastener 25 into the threaded receptacle 23 of the leg 15 and rotating the leg 15. Bolt head housing 33 prevents the fastener 25 from rotating. The height of the table 11 is greater when the fastener 25 is located in the longer support 21 and attached to the upper end of the leg 15 than when the fastener 25 is located in the shorter support 19 and attached to the upper end of the leg 15.

To change the height of table 11, the legs 15 are rotated to loosen each leg 15 from each fastener 25. Then each fastener 25 is moved slidingly through the slot 37 from one aperture 31 to the other. Then each leg 15 is tightened again. If fastener 25 is long enough, the leg 15 may remain loosely attached to fastener 25 while the fastener 25 is moved. The leg 15 will be inclined to clear the sidewall of the longer support 21 during movement of fastener 25. Fastener 25 is slidably moved through the slot 37 into the longer support 21 and tightened to the upper end of the leg 15 to increase the height of the table 11. The fastener 25 is slidably moved through the slot 37 and into the shorter support 19 and tightened to the upper end of the leg 15 to decrease the height of the table 11.

The invention has significant advantages. It provides for easy height adjustment of the table. Changing the height of the table requires only the sliding of the fastener between the longer support and the shorter support and requires no additional tools. The legs may be removed from the brackets for easier movement and storage.

While the invention has been shown in only one of its forms it should be apparent to those skilled in the art that it is not so limited, and that various changes may be made without departing from the scope of the invention.

What is claimed is:

1. In an article of furniture having a plurality of legs for supporting the article of furniture, an improved device for adjusting a height of the article of furniture, comprising in combination:

a plurality of brackets, each for one of the legs, each of the brackets having a shorter support and a longer support;

means for rigidly attaching each of the brackets to the article of furniture;

an aperture in the shorter support;

an aperture in the longer support;

a slot extending between the aperture in the shorter support and the aperture in the longer support; and fastener means which extends selectively through each of the apertures and is slidably movable in the slot between the aperture in the shorter support and the aperture in the longer support and which engages an upper end of each leg for selectively securing an upper end of each leg to the shorter support and alternately for selectively securing an upper end of each leg to the longer support, wherein the height of the article of furniture is greater when each leg is secured to the longer support than when each leg is secured to the shorter support.

2. The article of furniture according to claim 1, wherein the fastener means is a threaded member.

3. The article of furniture according to claim 1, wherein the fastener means comprises:

a threaded receptacle in the upper end of each of the legs; and a threaded fastener which extends selectively through each of the apertures and engages the threaded receptacle in the upper end of each leg.

4. An article of furniture comprising in combination:

a platform;

a plurality of legs each having an upper end;

a plurality of brackets, one for each of the legs;

attachment means for attaching each of the brackets to an underside of the platform;

each of the brackets having a shorter support and a longer support which extends farther from the article of furniture than the shorter support, each support having an end and an aperture therethrough;

a slot having one end terminating at the aperture of the shorter support and another end terminating at the aperture of the longer support;

a fastener extending through the slot of each of the brackets, the fastener being slidably moveable between the end of the slot in the shorter support and the end of the slot in the longer support and engaged with the upper end of one of the legs to selectively secure the leg to one of the supports, wherein the height of the article of furniture is greater when the fastener is located in the longer support and attached to the upper end of the leg than when the fastener is located in the shorter support and attached to the upper end of the leg.

5. The article of furniture according to claim 4 wherein the fastener is threaded and each of the legs has a threaded receptacle in its upper end for receipt of the fastener.

6. The article of furniture according to claim 4 wherein:

each of the legs has a threaded receptacle in its upper end;

each fastener has a head and a threaded shank which extends downward from the bracket for engaging the threaded receptacle in one of the legs; and each of the supports has a retainer at each end of the slot within each of the supports, the retainer being dimensioned to receive and retain the head of the fastener against rotation.

7. The article of furniture according to claim 4 wherein the longer supports are tubular in shape.

8. The article of furniture according to claim 4 wherein the longer support has a tubular sidewall and wherein the slot extends through the sidewall to interconnect the ends of the slot.

9. The article of furniture according to claim 4 wherein the attachment means comprises a base, a plurality of holes extending through the base, and a plurality of screws extending through the holes in the base to affix the base to the underside of the platform.

10. An apparatus for adjustably securing a leg to an article of furniture for adjusting the effective height of the leg, the article of furniture having a platform, each of the legs having an upper end containing a threaded receptacle, the apparatus comprising in combination:

a bracket having a base;

attachment means to rigidly affix the base to the underside of the platform;

the bracket having a shorter support and a longer support, each integrally joined to the base, the longer support protruding farther from the base than the shorter support, the longer support having a tubular sidewall;

each of the supports having an end and an aperture extending therethrough, a slot having one end terminating at the aperture in the shorter support and another end terminating at the aperture in the longer support, the slot extending through the tubular sidewall of the longer support to interconnect the apertures;

a threaded fastener extending through the slot and being slidably moveable between the aperture of the shorter support and the aperture of the longer support for selectively securing an upper end of a leg to the shorter support and for selectively securing an upper end of the leg to the longer support, the threaded fastener having a head that has a diametrical dimension, the slot having a width that is less than the diametrical dimension of the head; and a retainer at each aperture of the slot within each of the supports, the retainer being dimensioned to receive and retain the head of the threaded fastener against rotation.

11. The article of furniture according to claim 10, wherein the tubular sidewall of the longer support is cylindrical in shape.

12. A method of adjusting the height of an article of furniture having a plurality of legs, the method comprising:

rigidly mounting a bracket for each of the legs to an underside of the article of furniture, and providing each of the brackets with a longer support and a shorter support;

providing an aperture in the longer support and in the shorter support;

providing a slot having one end terminating at the aperture of the longer support and another end terminating at the aperture of the shorter support;

extending a threaded fastener selectively through the aperture of the longer support into engagement with an upper end of the leg; and rotating the leg to tighten the leg to the longer support; and, if lesser height is desired, rotating the leg to loosen the fastener and sliding the fastener through the slot to move the fastener from the aperture of the longer support to the aperture of the shorter support; then rotating the leg to tighten the fastener into engagement with the leg.

* * * * *